US006120963A

United States Patent [19]

Park et al.

[11] Patent Number: 6,120,963

[45] Date of Patent: Sep. 19, 2000

[54] TONER COMPOSITION AND METHOD OF PREPARING TONER USING THE SAME

[75] Inventors: Moon-soo Park, Seoul; Soon-kil Hong, Suwon; Jin-young Noh, Kwangmyung, all of Rep. of Korea

[73] Assignee: Samsung Electronics Co., Ltd., Kyungki-do, Rep. of Korea

[21] Appl. No.: 09/186,896

[22] Filed: Nov. 6, 1998

Related U.S. Application Data

[60] Provisional application No. 60/066,319, Nov. 21, 1997.

[30] Foreign Application Priority Data

Feb. 27, 1998 [KR] Rep. of Korea ..... 98-6468

[51] Int. Cl.[7] ..... G03G 9/00

[52] U.S. Cl. ..... 430/110; 430/111; 430/137

[58] Field of Search ..... 430/110, 111, 430/137

[56] References Cited

U.S. PATENT DOCUMENTS

| | | | |
|---|---|---|---|
| 5,455,137 | 10/1995 | Diaz et al. | 430/110 |
| 5,789,131 | 8/1998 | Mikuriya et al. | 430/110 |

FOREIGN PATENT DOCUMENTS

| | | |
|---|---|---|
| 0 230 041 | 7/1987 | European Pat. Off. . |
| 0 371 811 | 6/1990 | European Pat. Off. . |
| 0 376 343 | 7/1990 | European Pat. Off. . |
| 42 02 462 | 8/1993 | Germany . |
| 63-247760 | 10/1988 | Japan . |
| 1-150154 | 6/1989 | Japan . |
| 2-6535 | 1/1990 | Japan . |
| 4-146448 | 5/1992 | Japan . |
| 10-237216 | 9/1998 | Japan . |

OTHER PUBLICATIONS

Patent Abstracts of Japan vol. 13, No. 57 (P–825), Feb. 9, 1989.

*Primary Examiner*—Mark Chapman

*Attorney, Agent, or Firm*—Burns Doane Swecker & Mathis L.L.P.

[57] ABSTRACT

A toner composition and a method of preparing toner particles using the toner composition. The toner composition comprises a monomer for a binding resin, a coloring agent, a stabilizer, a charge controller, a lubricant and a polymerization initiator, wherein the stabilizer is obtained by dispersing hydrophobic silica into distilled water of pH 10~14, and then adjusting pH of the dispersion into 6~8. The toner particles prepared from the toner composition have improved in charge quantity, average particle diameter and distribution in particle diameter. Particularly, when the toner composition contains a surfactant, dispersion property of the color agent and the charge controller can be improved, thereby resulting in a better image quantity.

11 Claims, 7 Drawing Sheets

TONER COMPOSITION AND METHOD OF PREPARING TONER USING THE SAME

This application claims priority under 35 U.S.C. §§119 and/or 365 to Provisional Application Ser. No. 60/066,319 filed in United States on Nov. 21, 1997; the entire content of which is hereby incorporated by reference.

BACKGROUND OF THE INVENTION

1. Field of the Invention

The present invention relates to a toner composition and a method of preparing toner using the same, and more particularly, to a toner composition having improved particle diameter and charge quantity characteristics of toner as well as improved dispersion property of a coloring agent, and a method of preparing toner using the toner composition.

2. Description of the Related Art

Recently, demand for printers has gradually increased with development in computer industries. Accordingly, the amount of toner used has also increased.

Toner particles used for displaying an image are generally prepared by a grinding method. According to the grinding method, a polymer bonding resin, a coloring agent and a charge controller, etc. are blended in a dry condition. Then, the mixture is melt-mixed and cooled. The resultant is ground to fine toner particles.

Toner particles prepared by the above method have a wide distribution of particle diameters. Because toner particles outside a predetermined diameter range must be excluded, it is an economically unfavorable method. Limitation in dispersion of the charge controller and the coloring agent, and the shape of the toner particles often leads to an unsatisfactory resolution. To solve these problems, spherical toner particles have been prepared by polymerization technique.

This polymerization technique is classified into an emulsion polymerization method and a suspension polymerization method. According to the emulsion polymerization method, the final toner particle is usually smaller than 5$\mu$m in diameter. It, however, causes an adverse effect on human body. As a result, it would be is difficult to use these particles to preferred printers. This is why the suspension polymerization method is a preferred polymerization method.

A method of preparing toner by the suspension polymerization method is described as follows.

Water is used as a reaction medium, and a monomer for a binding resin, a charge controller, a stabilizer, a lubricant and a coloring agent are added to the reaction medium, and then polymerization is performed.

After the polymerization is completed, spherical particles sediment inside the reaction mixture. The obtained particles are filtered and then dried, producing in toner particles.

Phosphate or hydrophobic silica is used as the stabilizer. When using phosphate as the stabilizer, however, the particle diameter of the final toner particles tends to be very large, i.e., over approximately 35 $\mu$m, and the particle diameter distribution shows a wide variation ranging from a few to hundred micrometers in diameter. These particles contributes to lowering charge characteristics, and thus do not have proper properties as toner.

On the other hand, when the hydrophobic silica is used as the stabilizer, it is very difficult for the silica to be dispersed into the water. As a result, the polymerization reaction cannot occur. Therefore, the hydrophobic silica must be solubilized in an organic solvent, such as methanol, before it could be miscible with the other constituents of the toner composition for the polymerization.

SUMMARY OF THE INVENTION

To solve the above problems, it is an objective of the present invention to provide a toner composition which has improved particle diameter characteristics of toner particles and dispersion properties of filler particles, such as a charge controller and a coloring agent.

It is another objective of the present invention to provide a method of preparing toner using the composition.

To achieve the first objective, there is provided a toner composition comprising a monomer for a binding resin, a coloring agent, a stabilizer, a charge controller, a lubricant and a polymerization initiator, wherein the stabilizer is obtained by dispersing hydrophobic silica into distilled water of pH 10~14, and then adjusting pH of the dispersion into 6~8.

To achieve the second objective, there is provided a method of preparing a toner composition comprising the steps of:

(a) adjusting the pH of distilled water to pH 10~14 with an aqueous base, and dispersing hydrophilic silica into the pH-adjusted distilled water;

(b) adjusting the pH of the mixture of the step (a) to pH 6~8;

(C)mixing a monomer for a binding resin, a polymerization initiator, a charge controller, a lubricant and a coloring agent, and adding the mixture to the resultant of the step (b);

(d) preparing toner particles by polymerizing the resultant of the step (c); and (e) removing foreign materials remaining on the surface of toner particles.

BRIEF DESCRIPTION OF THE DRAWINGS

The above objectives and advantages of the present invention will become more apparent by describing in detail preferred embodiments thereof with reference to the attached drawings in which.

DESCRIPTION OF THE PREFERRED EMBODIMENTS

Figure 1:
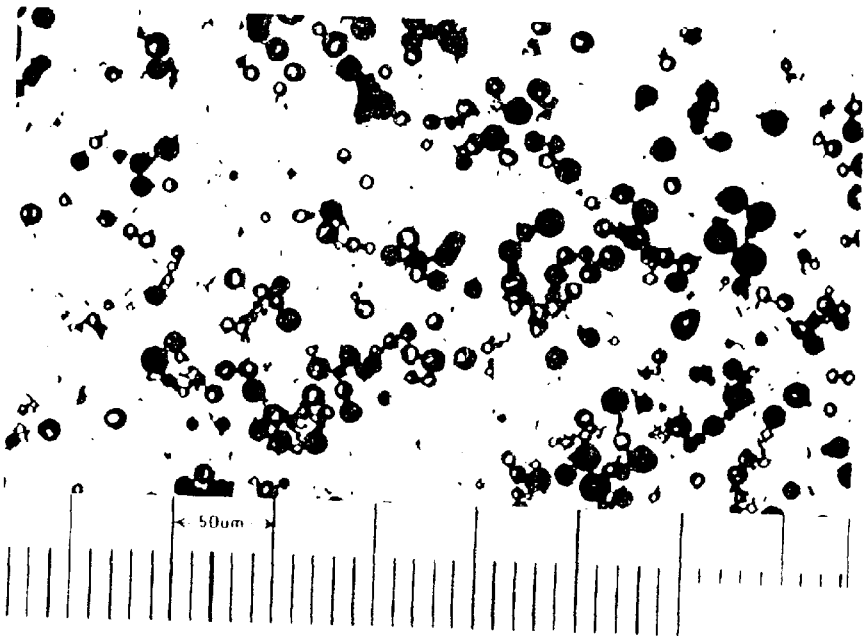
FIGS. 1 through 7 are optical microscope photographs of toner particles prepared by Examples 1 through 5 according to the present invention and Comparative Examples 3 and 4.
Figure 2:
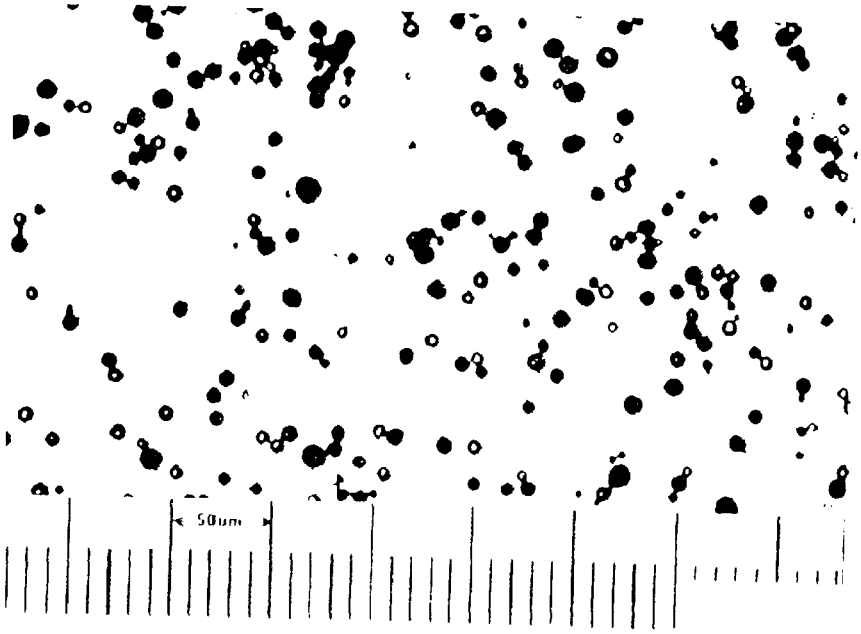
Figure 3:
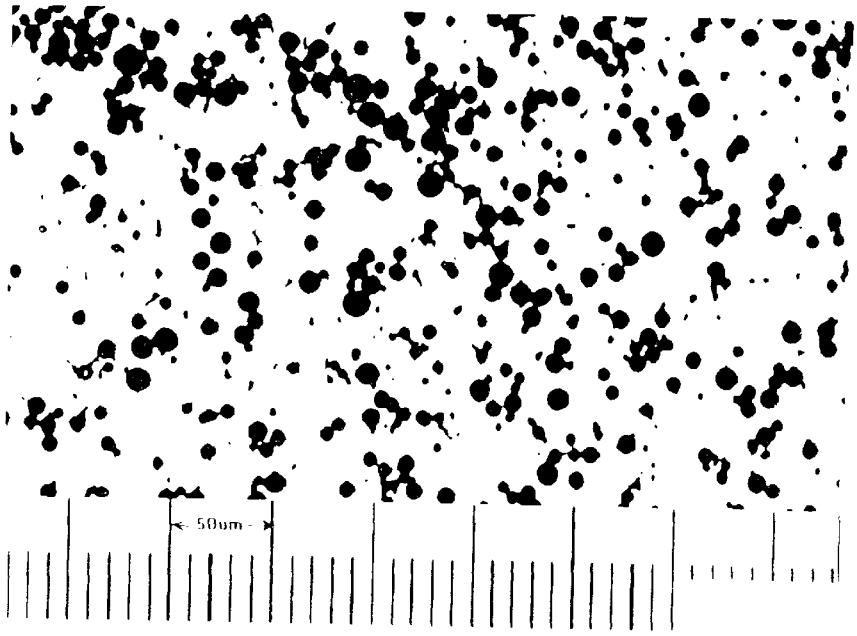
Figure 4:
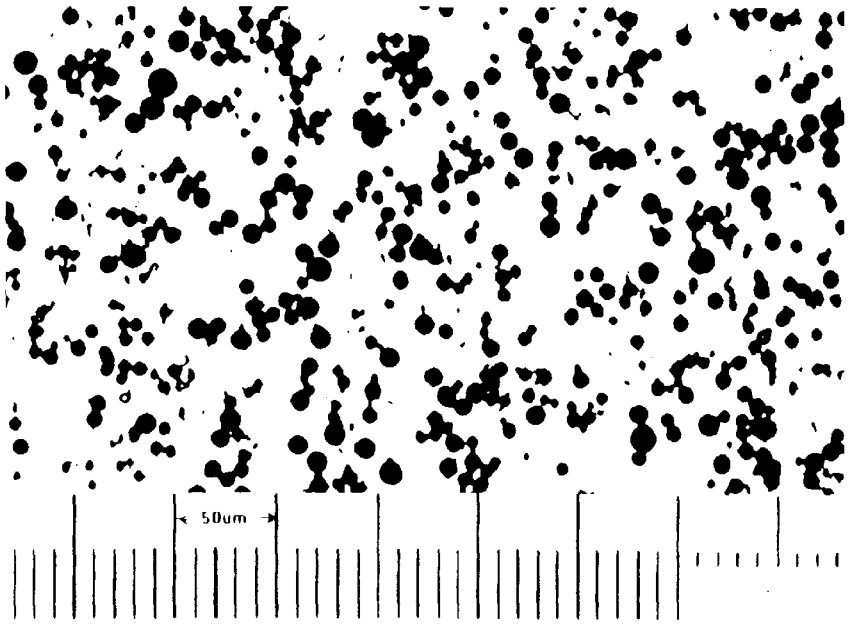
Figure 5:
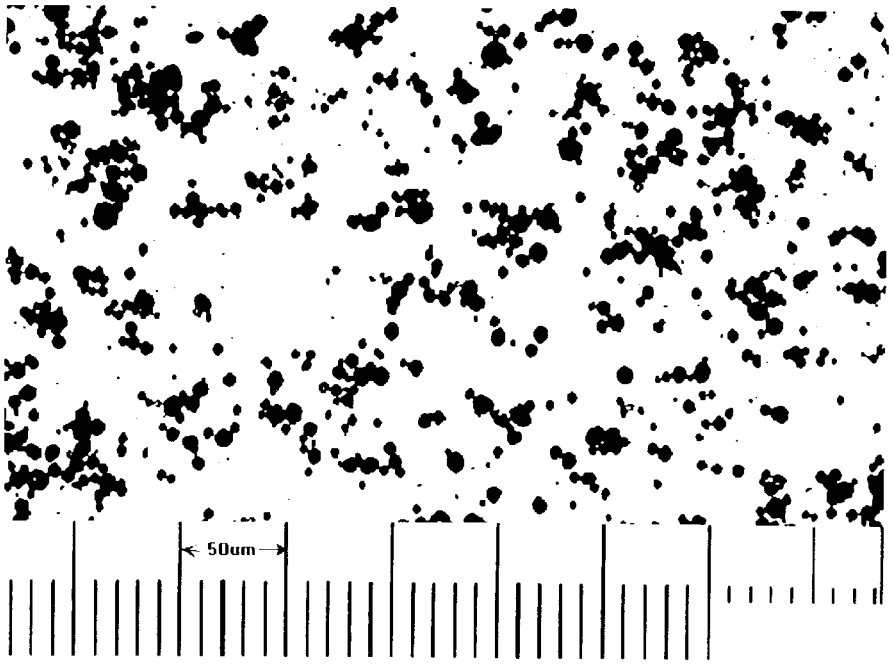

A toner composition of the present invention is characterized by a stabilizer which is obtained by dissolving hydrophobic silica in distilled water of pH 10~14, and then neutralizing the resultant to pH 6~8. When thus-obtained stabilizer is mixed with a monomer for a binding resin, a coloring agent, a charge controller, a lubricant and a polymerization initiator, a uniformly dispersed toner composition can be obtained unlike the conventional toner composition.

Preferably, the mixing ratio of the monomer for a binding resin and the silica solid content is between 50:1 and 25:1 by weight. Here, if the mixing content of the silica solid is over the above range, it is very difficult to recover toner particles polymerization. Also, if the mixing content of the silica solid is less than the above range, toner particles agglomerate unfavorably.

Also, the toner composition of the present invention may further comprise an ionic surfactant. Here, the ionic surfactant may be an anionic or cationic surfactant without restriction.

As the anionic surfactant, sodium lauryl sulfate is used. The cationic surfactant may be cetyltrimethylammonium bromide or cetryltrimethylammonium chloride. Also, preferably, the mixing ratio between the monomer for a binding resin and the surfactant is in the range of 1000:1~2000:1 by weight. Here, if the mixing content of the surfactant exceeds the above range, it is difficult to recover toner particles. On the other hand, if the mixing content of the surfactant is less than the above range, dispersion properties of filler particles become poor.

The monomer for a binding resin of the present invention includes any monomers generally used when preparing toner particles by polymerization. In the present invention, a combination of styrene and butylmethacrylate is used. Here, the mixing ratio of styrene and butylmethacrylate is 6:4~9:1 based on weight, preferably 7:3~8:2.

The charge controller of the present invention controls the charging properties of the toner, and includes any general charge controllers without limitations. Also, the coloring agent of the present invention is carbon black as a black pigment.

The lubricant of the present invention improves fluidity of toner particles. Here, wax is used for this purpose. Also, the polymerization initiator may be any general polymerization initiator.

Hereinafter, a method of preparing toner particles using the toner composition of the present invention will be described.

After adjusting the pH of distilled water to 10~14 using an aqueous base, hydrophobic silica is dispersed into the pH-adjusted distilled water. Then, the mixture is neutralized to pH 6~8. Here, the aqueous base may be sodium hydroxide, potassium hydroxide or ammonium hydroxide without limitation. Also, so as to neutralize the hydrophobic silica dispersion of pH 10~14, any acid may be used without restriction. However, formic acid is preferred.

A mixture of a monomer for a binding resin, a charge controller, a coloring agent, a lubricant and a polymerization initiator is added to the resultant, and then uniformly mixed. If required, an ionic surfactant, preferably, an cationic surfactant, may be further added to the mixture. This mixing process is preferably performed by a ball mill.

Then, polymerization is performed on the resultant under nitrogen atmosphere. After the polymerization is completed, unreacted residues are removed from the reaction mixture using methanol. Here, if a conversion ratio of the polymerization reaction reaches as low as 70~80%, then methanol is preferably used to remove the unreacted residues. On the other hand, if the conversion is found to be as high as 80% or over, the unreacted residues are preferably removed using distilled water.

Then, the obtained precipitate is filtered, and foreign materials remaining on the surface of the precipitate are removed using a dilute potassium hydroxide aqueous solution or methanol. The resultant from which the foreign materials were removed is dried in a vacuum oven for a predetermined time, thereby resulting in toner particles of the present invention.

The average diameter of the toner particles obtained by the above method is 5~20 $\mu$m, the charge quantity is −10~20 $\mu$c/g, and the glass transition temperature is 60~75° C.

Hereinafter, the present invention will be described through the following examples. However, the present invention is not limited to the following examples.

EXAMPLE 1

Ammonium hydroxide aqueous solution was added to 600 ml of distilled water to adjust the pH to approximately 10, and then 6 g of hydrophobic silica S-972 (Degussa Co.) was added to the pH-adjusted distilled water. Then, the resultant was stirred using a homogenizer at 5,000 rpm for 10 minutes. Then, the resultant was neutralized using formic acid to prepare a first composition.

140 ml of styrene, 60 ml of butylmethacrylate, 4 g of 2,2-azobisisobutyronitrile, 6 g of Carbon black 2350 (Mitsubishi Co., average diameter: 15 nm), 2 g of Bontron S-34 (Orient Chemical Co.) and 2 g of wax were mixed to prepare a second composition.

The mixture of the first composition and the second composition was stirred in a ball-mill for 12 hours. Then, the polymerization was performed at 75° C. for 7 hours under a nitrogen atmosphere.

After the polymerization was completed, unreacted styrene and butylmethacrylate were removed from the reaction mixture using methanol. Then, the resultant was filtered and cleaned, and dried in a vacuum oven for 2 days, resulting in toner particles.

EXAMPLE 2

Toner particles were prepared by the same method as Example 1, except that the carbon black content was 10 g.

EXAMPLE 3

Toner particles were prepared by the same method as Example 1, except that 0.1 g of cetyltrimethylammonium bromide (CTAB) was additionally included in the first composition.

EXAMPLE 4

Toner particles were prepared by the same method as Example 1, except that sodium hydroxide solution was used to prepare an alkaline hydrophobic silica solution, instead of ammonium hydroxide aqueous solution.

EXAMPLE 5

Toner particles were prepared by the same method as Example 1, except that Printex L-6 (Degussa Co, average diameter: 18 nm) was used as carbon black, instead of Carbon black 2350 (Mitsubishi Co.).

COMPARATIVE EXAMPLE 1

400ml of distilled water and 100 ml of methanol were mixed, and then 6 g of hydrophobic silica R-972 (Degussa Co.) was dispersed into the mixture, to prepare a first composition.

140 ml of styrene and 60 ml of butylmethacrylate were mixed with 600 ml of distilled water, and then 4 g of 2,2-azobisisobutyronitrile, 6 g of carbon black, 2 g of Bontron S-34 and 2 g of wax were added to the mixture, to prepare a second composition.

After adding the second composition to the first composition, the polymerization was performed on the reaction mixture at 75° C. for 7 hours under a nitrogen atmosphere.

After the reaction was completed, unreacted styrene and butylmethacrylate were removed from the reaction mixture using methanol. Then, the resultant was filtered and cleaned, and then dried in a vacuum oven for 2 days, resulting in toner particles.

COMPARATIVE EXAMPLE 2

Toner particles were prepared by the same method as Example 1, except that di-n-butylamine was used to prepare the first composition instead of ammonium hydroxide aqueous solution.

COMPARATIVE EXAMPLE 3

3 g of tri-calcium phosphate ($Ca_3(PO_4)_2$, Yakuri Pure Chemicals) was added to 600 ml of distilled water, to prepare a first composition.

140 ml of styrene, 60 ml of butylmethacrylate, 2 g of 2,2-azobisisobutyronitrile, 6 g of Carbon black 2350 (Mitsubishi Co., average diameter: 15 nm), 2 g of Bontron S-34 (Orient Chemical Co.) and 2 g of wax were mixed to prepare a second composition.

After adding the second composition to the first composition, the mixture was stirred in a ball-mill for 12 hours. Then, the polymerization was performed at 75° C. for 7 hours under a nitrogen atmosphere.

After the reaction was completed, unreacted styrene and butylmethacrylate were removed from the reaction mixture using methanol. Then, the resultant was filtered and cleaned, and dried in a vacuum oven for 2 days, resulting in toner particles.

COMPARATIVE EXAMPLE 4

Toner particles were prepared by the same method as Example 1, except that the first composition and the second composition were mixed in a homogenizer.

Toner particles were prepared by the same method as Example 1, except that the first composition and the second composition were mixed in a homogenizer.

According to Comparative Example 1, the conversion of the polymerization reaction was very low, and it was difficult to obtain spherical toner particles after the polymerization. Also, in the case when the first composition was prepared by using n-butyl alcohol (Comparative Example 2), the hydrophobic silica agglomerated, such that it was difficult to obtain a uniform first composition. Thus, the polymerization reaction to form the toner particles could not be conducted.

Characteristics of the toner particles prepared by the Examples 1–5 and Comparative Examples 3–4 was evaluated as follows.

Particle diameters of the toner particles and particle diameter distribution were measured by a coulter counter or a laser particle diameter analyzer, and the surface of the toner particles was analyzed with a scanning electron microscope (SEM).

Dispersion properties of carbon black in the toner particles were evaluated with an optical microscope (Labophot-2, Nicon Co.), and represented as follows:

◎:carbon black is very finely dispersed;

○: carbon black is finely dispersed;

Δ: large particles of carbon black are slightly visible; and x: large particles of carbon black are clearly visible.

The glass transition temperature was measured by using a differential scanning calorimeter (DSC), and the molecular weight was measured with a gel permeation chromatography (GPC).

The charge quantity of toner particles was measured by using a blow-off meter (Toshiba Co.).

On the other hand, the toner particles prepared by the Examples 1–5 and Comparative Examples 3–4 were measured to analyze the dispersion state of the carbon black, the average particle diameter, the glass transition temperature and the charge quantity. Their results are tabulated in Table 1.

| classification | dispersion state of carbon black | average particle diameter (μm) | glass transition temperature (° C.) | charge quantity (μc/g) |
|---|---|---|---|---|
| Example 1 | ○ | 12.57 | 68.04 | −11.54 |
| Example 2 | ○ | 13.76 | 66.14 | −12.16 |
| Example 3 | ◎ | 12.87 | 64.37 | −15.48 |
| Example 4 | ◎ | 12.75 | 67.48 | −12.16 |
| Example 5 | ◎ | 5.25 | 66.22 | −20.27 |
| Comparative Example 3 | Δ | 38.28 | 65.36 | +7.35 |
| Comparative Example 4 | Δ | 26.99 | 66.12 | −9.56 |

As can be seen from Table 1, the toner particles prepared by Examples 1–5 have excellent degree of dispersion compared with Comparative Examples 3 and 4.

Particularly, the diameter of the toner particles prepared by Comparative Example 3 tends to be divided into two classes, i.e., 20 μm or more and 10 μm or less. In this case, pigments are dispersed to some extent within the toner particles having 20 μm or more in diameter while the pigment cannot be incorporated into the toner particles having 10 μm or less in diameter.

Figure 6:
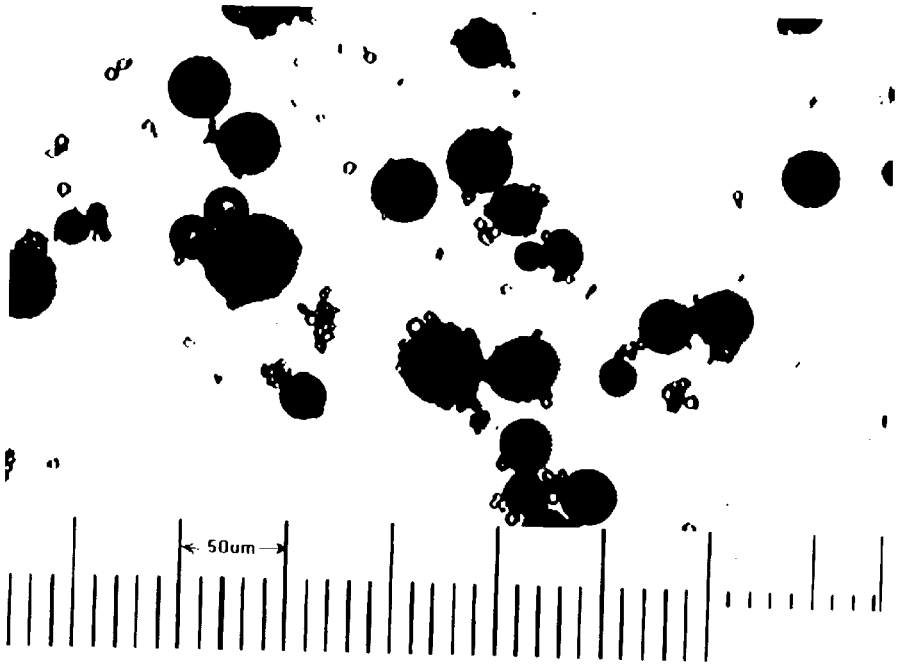
Figure 7:
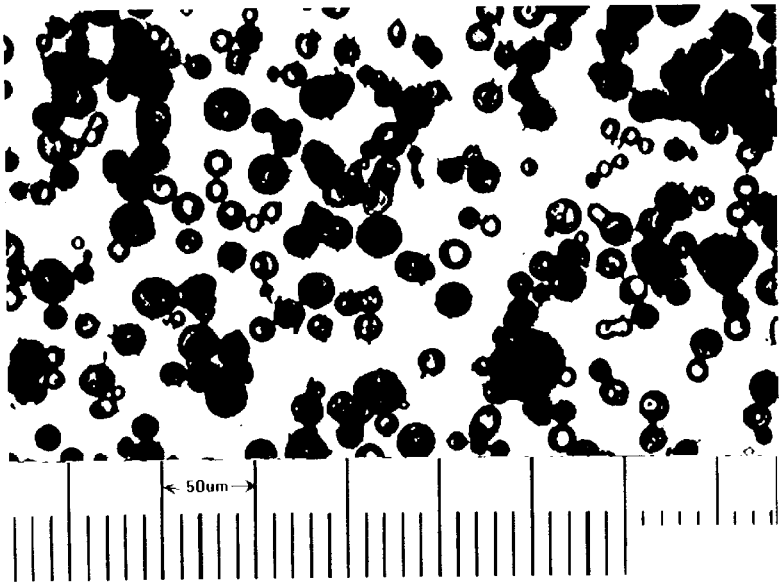
Figure 8:
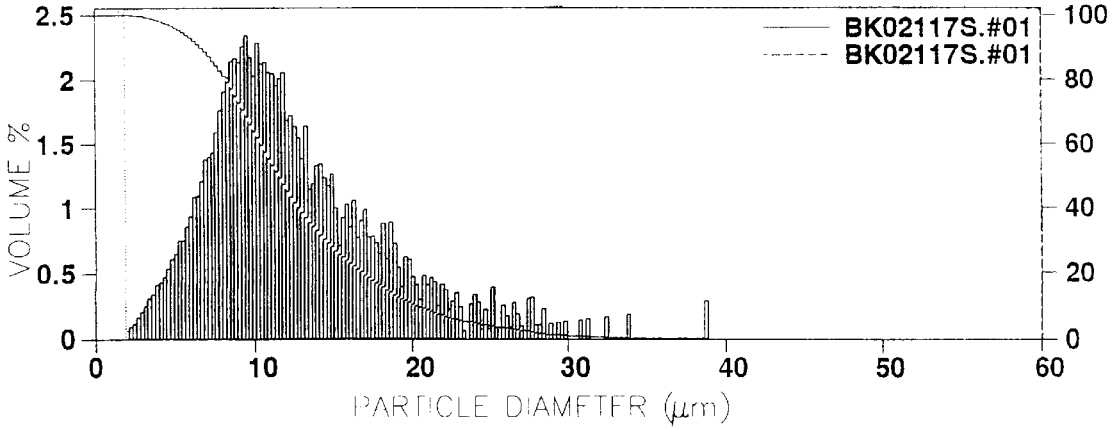
FIGS. 8 through 14 are diagrams showing distribution of particle diameter of toner particles prepared by Examples 1 through 5 according to the present invention and Comparative Examples 3 and 4.
Figure 9:
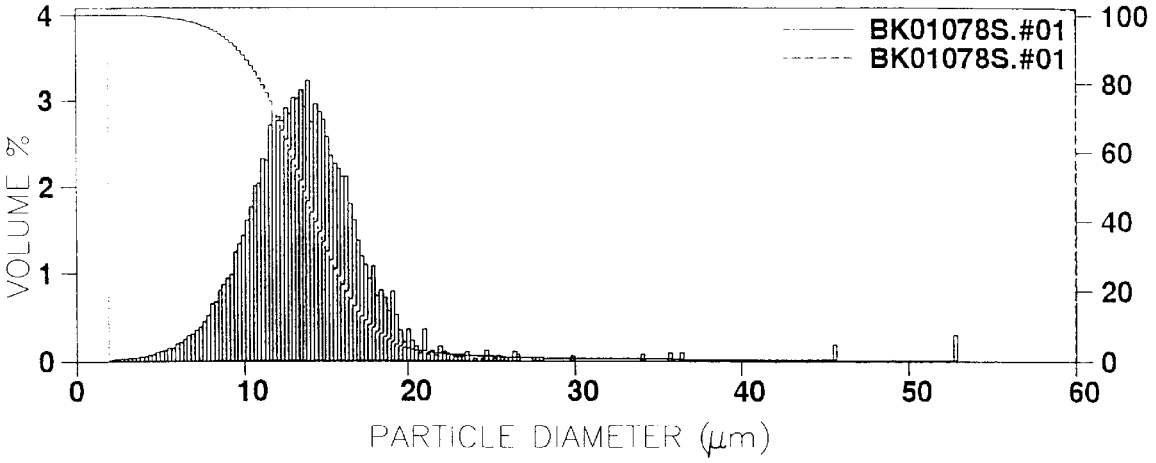
Figure 10:
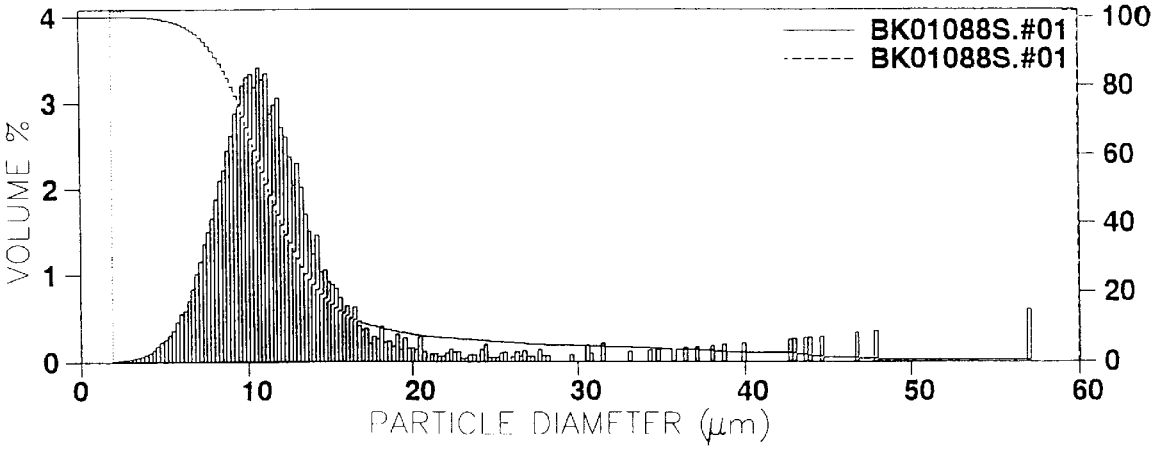
Figure 11:
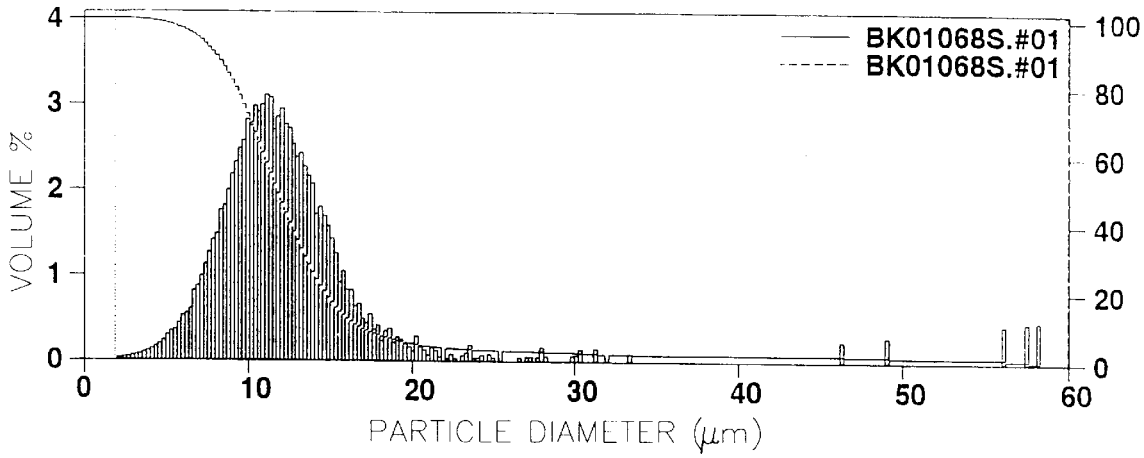
Figure 12:
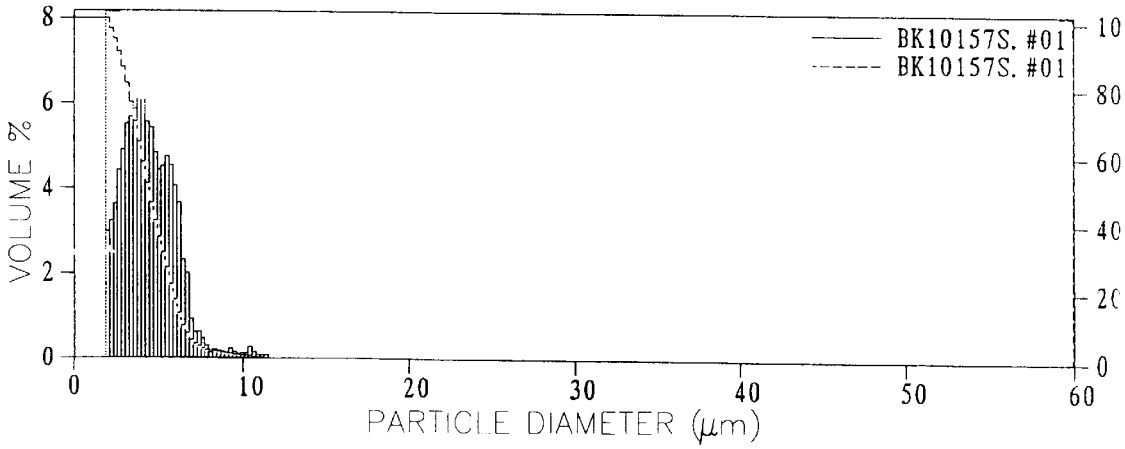
Figure 13:
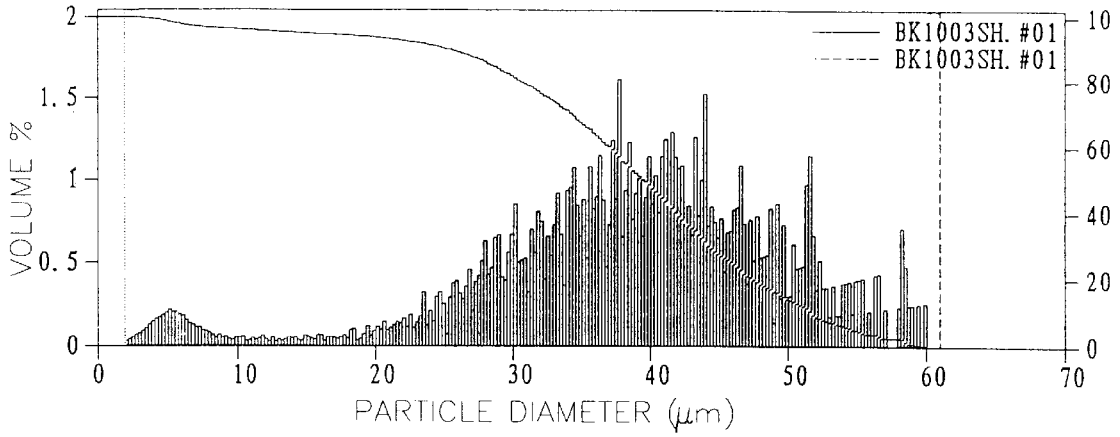
Figure 14:
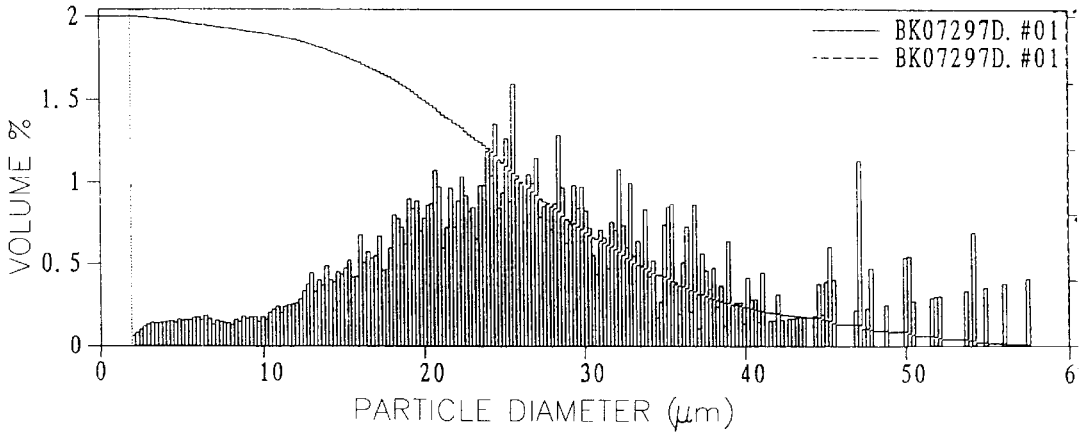

FIGS. 1 through 5 are optical microscope photographs of the toner particles prepared by Examples 1 through 5, and FIGS. 6 and 7 are optical microscope photographs of the toner particles prepared by Comparative Examples 3 and 4.

Referring to FIGS. 1 through 5, it can be seen that the toner particles of Examples 1 through 5 have excellent degree of dispersion of the carbon black compared with Comparative Examples 3 and 4. In Particular, referring to FIG. 3, in the case when cetyltrimethylammonium bromide (CTAB) is additionally added (Example 3), the carbon black is evenly dispersed into the toner particles.

Particle distribution of the toner particles prepared by Examples 1–5 and Comparative Examples 3 and 4 are shown in FIGS. 8 through 14.

Referring to FIGS. 8 through 14, the distribution characteristics in particle diameter of the toner particles is improved in Examples 1 through 5, compared with Comparative Examples 3 and 4.

Also, as can be seen from Table 1, the toner particles prepared by Examples 1–5 show improvement in the charge quantity and the average particle diameter, compared with Comparative Examples 3 and 4.

Toner particles having improved in charge quantity, average particle diameter and particle diameter distribution can be prepared from the toner composition of the present invention. Particularly, when the toner composition contains a surfactant, toner particles exhibiting improved dispersion properties of the coloring agent and charge controller can be obtained, thereby resulting in a better image quality.

What is claimed is:

1. A toner composition that is prepared by polymerization of a composition comprising one or more monomers for a binding resin, a coloring agent, a stabilizer, a charge controller and a polymerization initiator, wherein the stabilizer is obtained by dispersing hydrophobic silica into distilled water of pH 10~14, and then adjusting the pH of the dispersion into 6~8.

2. The toner composition of claim 1, wherein the mixing ratio of the one or more monomers for a binding resin and the silica solid content is between 50:1 and 25:1 by weight.

3. The toner composition of claim 1, further comprising an ionic surfactant.

4. The toner composition of claim 3, wherein the mixing ratio of the one or more monomers for binding resin and the ionic surfactant is between 1000:1 and 2000:1 by weight.

5. The toner composition of claim 3, wherein the ionic surfactant is selected from the group consisting of sodium lauryl sulfate, cetyltrimethylammonium bromide and cetyltrimethylammonium chloride.

6. A method of preparing a toner composition comprising the steps of:

(a) adjusting the pH of distilled water to pH 10~14 with an aqueous base, and dispersing hydrophilic silica into the pH-adjusted distilled water;

(b) adjusting the pH of the mixture of the step (a) to pH 6~8;

(c) mixing one or more monomers for a binding resin, a polymerization initiator, a charge controller, a lubricant and a coloring agent, and adding the mixture to the resultant of the step (b);

(d) preparing toner particles by polymerizing the resultant of the step (c); and (e) removing foreign materials remaining on the surface of the toner particles.

7. The method of claim 6, wherein the aqueous base is selected from the group consisting of ammonium hydroxide, sodium hydroxide and potassium hydroxide.

8. The method of claim 6, wherein the mixing ratio of the one or more monomers for a binding resin and the silica solid content is between 50:1 and 25:1 by weight.

9. The method of claim 6, wherein in the step (c) of mixing the one or more monomers for a binding resin, the polymerization initiator, the charge controller, the lubricant and the coloring agent, an ionic surfactant is further added.

10. The method of claim 9, wherein the ionic surfactant is selected from the group consisting of sodium lauryl sulfate, cetyltrimethylammonium bromide and cetyltrimethylammonium chloride.

11. The method of claim 9, wherein the mixing ratio of the monomer for binding resin and the ionic surfactant is between 1000:1 and 2000:1 by weight.

* * * * *

UNITED STATES PATENT AND TRADEMARK OFFICE

CERTIFICATE OF CORRECTION

PATENT NO. : 6,120,963
DATED : September 19, 2000
INVENTOR(S) : Moon-soo Park, Soon-kil Hong, Jin-young Noh It is certified that error appears in the above-identified patent and that said Letters Patent is hereby corrected as shown below:

Title page,
Item [73], Assignee, *after* Samsung Electronics Co., Ltd., add
-- and Cheil Industries, Inc. --, and *after* Kyungki-do, Republic of Korea add
-- and Kyungsangbuk-do, Republic of Korea --

Signed and Sealed this

Eighth Day of January, 2002

*Attest:*

*Attesting Officer*

JAMES E. ROGAN
*Director of the United States Patent and Trademark Office*